US012320215B2

(12) United States Patent
St George et al.

(10) Patent No.: US 12,320,215 B2
(45) Date of Patent: Jun. 3, 2025

(54) RADIAL WELLBORE SATELLITE LAUNCHER SYSTEM

(71) Applicant: Isolation Equipment Services Inc., Red Deer (CA)

(72) Inventors: Ed St George, Red Deer (CA); Boris P Cherewyk, Red Deer (CA)

(73) Assignee: Isolation Equipment Services Inc., Red Deer (CA)

( * ) Notice: Subject to any disclaimer, the term of this patent is extended or adjusted under 35 U.S.C. 154(b) by 0 days.

(21) Appl. No.: 18/401,921

(22) Filed: Jan. 2, 2024

(65) Prior Publication Data

US 2024/0218754 A1 Jul. 4, 2024

Related U.S. Application Data

(60) Provisional application No. 63/436,427, filed on Dec. 30, 2022.

(51) Int. Cl.

| | |
|---|---|
| ***E21B 23/04*** | (2006.01) |
| ***E21B 33/068*** | (2006.01) |
| ***E21B 34/14*** | (2006.01) |

(52) U.S. Cl.

CPC ..... *E21B 23/0413* (2020.05); *E21B 33/068* (2013.01); *E21B 34/142* (2020.05)

(58) Field of Classification Search

CPC .. E21B 23/0413; E21B 33/068; E21B 34/142; E21B 33/05; E21B 33/165; Y10T 137/4891

See application file for complete search history.

(56) References Cited

U.S. PATENT DOCUMENTS 8,136,585 B2 * 3/2012 Cherewyk ..... E21B 33/068 15/104.062

* cited by examiner

*Primary Examiner* — Yong-Suk (Philip) Ro

(74) *Attorney, Agent, or Firm* — Troutman Pepper Locke LLP

(57) ABSTRACT

Apparatuses for injecting a plurality of satellites into a wellhead are disclosed. The apparatuses have a housing with an axial bore therethrough in communication with a wellbore of the wellhead. One or more satellite cartridges are arranged radially around the axial bore on a surface of the housing, each of the one or more satellite cartridges for releasably retaining at least one of the plurality of satellites. One or more actuators move the one or more satellite cartridges in alignment with the axial bore to inject one of the plurality of satellites into the axial bore. The apparatuses are operable in a system comprising a staging block in communication with the axial bore, a first actuator to selectably obstruct fluid communication between the staging block and the axial bore, and a second actuator to selectably obstruct fluid communication between the staging block and the wellbore.

20 Claims, 8 Drawing Sheets

RADIAL WELLBORE SATELLITE LAUNCHER SYSTEM

CROSS-REFERENCE TO RELATED APPLICATION

This application claims priority to U.S. Provisional Patent No. 63/436,427 filed on Dec. 30, 2022, the entirety of which is incorporated herein by reference.

FIELD OF THE DISCLOSURE

The present disclosure relates generally to apparatuses for injecting satellites into a wellbore, such as darts and packer balls. More particularly, apparatuses using a housing having at one or more cartridges actuated towards and away from an axial bore for launching satellites.

BACKGROUND

Applicant's U.S. Pat. No. 8,136,585 discloses an apparatus for successively releasing balls into a wellbore during wellbore operations is disclosed. The apparatus has a radial housing having at least one radial ball array having two or more radial bores. Each radial bore houses a ball cartridge adapted to receive and release balls and an actuator for operably aligning or misaligning the ball cartridge with an axial bore in fluid communication with the wellbore. The ball cartridge is moveable along the radial bore and is operable between an aligned position, for releasing a ball and a misaligned position for storing the ball, the entirety of which is herein incorporated by reference.

Applicant's U.S. Provisional Patent Nos. 63/430,456 and 63/430,871 disclose a satellite launcher having a body comprising a planar surface and an axial bore; a plurality of satellite tubes, each satellite tube for releasably retaining a satellite and having an open end for facing the planar surface; a first and a second track system, each comprising: a track extending along the planar surface through the axial bore with a track opening at the axial bore, a magazine slideably attached to the track, the magazine for detachably retaining satellite tubes, and a actuator for moving the first magazine along the first track. The track of the second track system angularly offset from the track of the first track system relative to the axial bore, the second track defining a second track opening at the axial bore. When one of the satellite tubes is aligned with the axial bore, the satellite contained therein is free to drop out, the entirety of which is herein incorporated by reference.

There remains a need for a safe, efficient and remotely operated apparatus and mechanism for introducing or deploying including balls, elongated downhole actuators, and/or the like to a wellbore for applications such as multi-stage fracturing pumping stimulations.

SUMMARY

Embodiments herein relate to a satellite injecting apparatus for releasing satellites into a wellhead having a wellbore having a housing adapted to be supported by the wellhead, the housing having an axial bore therethrough, and one or more satellite cartridges radially arranged around the wellbore and comprising actuators for moving the satellite cartridges towards and away from the axial bore for selectively launching satellites into the wellbore.

In a broad aspect of the present disclosure, an apparatus for injecting satellites into a wellhead having a wellbore comprises: a housing adapted to be supported by the wellhead, the housing having an axial bore therethrough in communication with the wellbore; one or more satellite cartridges arranged radially around the axial bore on a surface of the housing, each satellite cartridge: for releasably retaining a satellite, having an open end facing the surface, and moveable along the surface; and one or more actuators for moving the one or more satellite cartridges along the surface, wherein when the open end of one of the one or more satellite cartridges is aligned with the axial bore, a satellite contained therein is injected into the axial bore.

In some embodiments, the one or more cartridges comprises one or more apertures; and the one or more actuators comprise one or more stop pins, the stop pins for selectably engaging the one or more apertures for selectably retaining one of the one or more cartridges in a fixed position on the surface.

In some embodiments, the apparatus further comprises one or more stackable trays for containing one or more satellite cartridges, the trays being stackable on the housing and other trays.

In some embodiments, one or more of the actuators is remotely controllable.

In some embodiments, one or more of the actuators is one of a screw drive, a chain and sprocket drive, a winch and cable drive, an air driven cylinder drive, spring driven/biased, a hydraulic cylinder drive, and a gear rack drive.

In some embodiments, each of the actuators comprise an indicator to visually indicate if the actuator is proximate or distal the axial bore.

In some embodiments, one or more of the satellite cartridges comprise a satellite tube for releasably retaining a satellite.

In some embodiments, the satellite tubes comprise translucent plastic.

In some embodiments, the satellite tubes further comprise metal.

In some embodiments, the satellite tubes are at least one of colour coded and numbered.

In some embodiments, each satellite tube comprises a moveable rod axially extending from the satellite tube for indicating whether a satellite is in the satellite tube.

In some embodiments, the end of the rod distal the satellite tube comprises an indicator.

In some embodiments, the satellite tubes are thermally insulative.

In some embodiments, each of the satellite tubes comprise a heating coil.

In some embodiments, each of the satellite tubes comprise a cap on an end distal the wellbore.

In some embodiments, the apparatus further comprises a drop sensor to confirm that a satellite has been injected to the wellbore.

In some embodiments, the satellites are at least one of darts and packer balls.

In some embodiments, the housing comprises a safety assembly.

In some embodiments, a system for deploying satellites into the wellbore comprises: the apparatus; a staging block in communication with the axial bore; a first actuator to selectably obstruct fluid communication between the staging block and the axial bore, the first actuator for selectably retaining a satellite above and releasing a satellite into the staging block; and a second actuator selectably obstruct fluid communication between the staging block and the wellbore, the second actuator for selectably retaining the satellite in the staging block and deploying the satellite into the wellbore.

In some embodiments, the system further comprises a pressure sensor in the staging block and the first actuator is configured to obstruct fluid communication between the staging block and the axial bore when the pressure sensor detects that the staging block is pressurized or if the second actuator is open.

BRIEF DESCRIPTION OF THE DRAWINGS

For a more complete understanding of the disclosure, reference is made to the following description and accompanying drawings, in which.

DETAILED DESCRIPTION

Unless otherwise defined, all technical and scientific terms used herein generally have the same meaning as commonly understood by one of ordinary skill in the art to which this disclosure pertains. Exemplary terms are defined below for ease in understanding the subject matter of the present disclosure.

The term "a" or "an" refers to one or more of that entity; for example, "a dart" refers to one or more dart or at least one dart. As such, the terms "a" (or "an"), "one or more" and "at least one" are used interchangeably herein. In addition, reference to an element or feature by the indefinite article "a" or "an" does not exclude the possibility that more than one of the elements or features are present, unless the context clearly requires that there is one and only one of the elements. Furthermore, reference to a feature in the plurality (e.g., systems), unless clearly intended, does not mean that the systems or methods disclosed herein must comprise a plurality.

The expression "and/or" refers to and encompasses any and all possible combinations of one or more of the associated listed items (e.g. one or the other, or both), as well as the lack of combinations when interrupted in the alternative (or).

Embodiments disclosed herein are discussed in the context of the actuation of a series of satellites such as darts, packer balls, and/or the like within a wellbore for isolating subsequent zones within a formation for fracturing of the zones. A series of packers typically uses a series of different sized darts and/or balls for sequential blocking of adjacent packers. One of skill in the art however, would appreciate that some of the embodiments disclosed herein are applicable to any operation requiring the dropping of one or more darts and/or balls in the wellbore.

Satellites such as darts and/or balls have been dropped from surface through a tubular in the wellbore into a seat of a downhole tool for blocking flow and permitting changes in pumped pressure to actuate downhole equipment such as movement of a sliding sleeve, opening and closing of a port, movement of a valve, fracturing of a frangible element, release of cementing wiper plugs, control of downhole packers, sealing perforations and/or the like. The dimensions of a satellite and the sequence of release of the one or more satellites is relevant to actuation of a series of packers for operations, which can include applications such as fracturing, acid stimulation, and stimulation procedures directed to zones of interest within the formation surrounding the wellbore.

Figure 1:
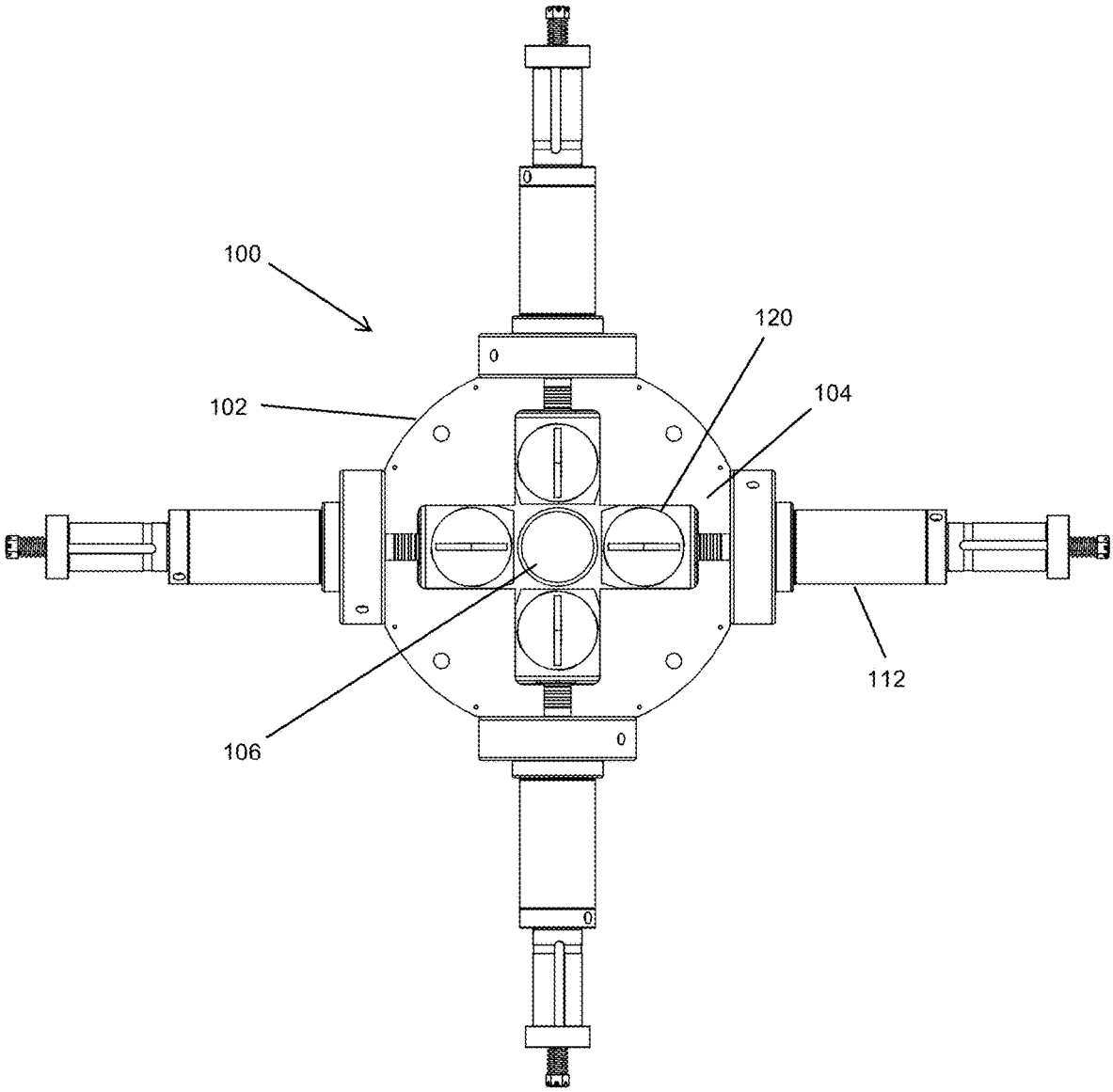
FIG. 1 is top view of an embodiment of a satellite injecting apparatus having four cartridges.

FIG. 1 illustrates an embodiment of a radial satellite injecting apparatus 100 for injecting, delivering or releasing satellites 116, such as darts, packer balls, an/or the like into a wellhead having a wellbore. The apparatus 100 comprises a housing 102 adapted to be supported to by the wellhead, the housing 102 having planar surface 104 and an axial bore 106 defined therein. The axial bore 106 going through the planar surface 104 and in communication with the wellbore or a component of the radial satellite injecting apparatus 100 located towards the wellbore relative to the planar surface 104. The planar surface 104 may be any appropriate shape such as rectangular, circular, and/or the like or may be of an irregular shape with cut-outs.

The satellite launcher 100 further comprises one or more satellite cartridges 108 for releasably retaining a satellite 116 and having an open end 108A arranged to face the axial bore 106. Each of the cartridges 108 is for housing a satellite 116 individually and securely. While FIG. 1 to FIG. 7 show four cartridges 108, any number of cartridges 108, such as three, five or more, etc. may be used as appropriate for a particular application. For each cartridge 108, the radial satellite injecting apparatus 100 comprises an actuator 112 for moving the satellite cartridge 108 towards and away from the axial bore 106. The satellite cartridges 108 may move along the surface of the planar surface 104 or they may move along a groove 114, track, guide rods, and/or the like. The actuator 112 may be for moving the cartridges 108 towards and away from the axial bore 106. Alternatively, the cartridges 108 may be biased away from the axial bore 106 using a biasing mechanism such as a spring, wherein the actuator 112 is for overcoming the biasing mechanism to move the cartridge 108 towards the axial bore. The actuator may be a screw drive, a chain and sprocket drive, a winch and cable drive, an air driven cylinder drive, spring driven/biased, a hydraulic cylinder drive, a gear rack drive, and/or the like. The cartridges 108 have an open end 108A such that when the cartridges 108 are positioned in alignment over the axial bore 106, the satellite 116 contained therein may be free to drop into the wellbore.

Figure 1A:
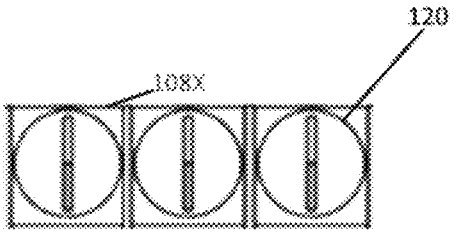
FIG. 1A is a top view of an alternative embodiment of a cartridge.
Figure 1B:
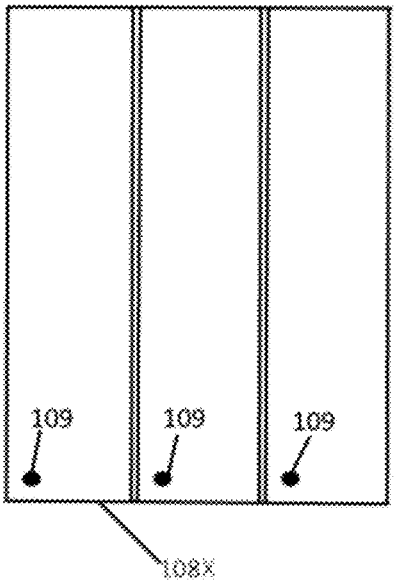
FIG. 1B is a side view of the cartridge of FIG. 1A.
Figure 1C:
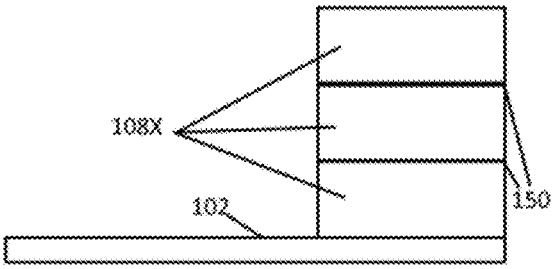
FIG. 1C is a side view of a plurality of stackable trays on the apparatus.
Figure 2:
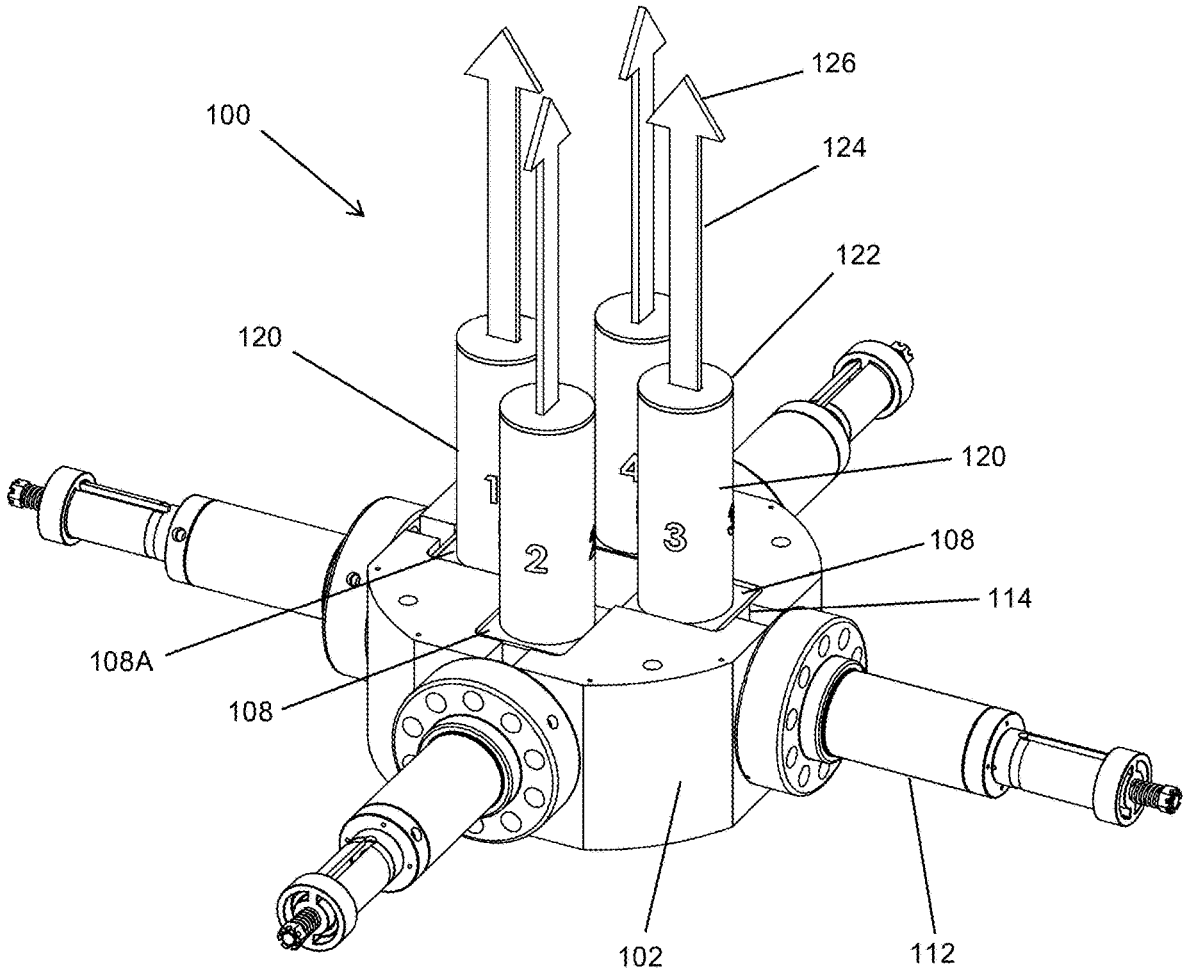
FIG. 2 is perspective view of a portion of an embodiment of a satellite injecting apparatus having four cartridges.

Referring to FIG. 1C, in some embodiments, one or more cartridges 108 and 108X may be placed on stackable trays 150. The trays 150 being stackable on the housing 102 and on one other for increasing the capacity of loaded satellites 116 in the apparatus. The stackable trays 150 may be placed on any location on or proximate the housing to allow changing or loading of cartridges (108, 108X) and/or satellites 116.

In some embodiments, the actuator 112 is a screw drive comprising a hydraulic screw actuator, an activation nut and a threaded axle. Alternatively, the screw drive may comprise a hydraulic motor in lieu of the activation nut, which hydraulic motor may comprise a hydraulic stop valve operative to stop a flow of hydraulic fluid to the hydraulic motor. In some embodiments, the actuator 112 comprises one or more sensors to confirm the travel thereof. In some embodiments, the sensor may precisely measure and record the number revolutions of the threaded axle to determine said travel. The number of rotations and distance travelling will depend characteristics of the darts and/or actuator. For example, 30 rotations may correspond to 5.0 inches of travel. The sensor may connect to an application or app in a user device, providing the device with data, which may be displayed as percentages that a satellite 116 is close to a desired position. The application or app in a user device may also be used to operate the satellite launcher 100 including the actuator 112, which may further comprise stop pins 118. The stop pins 118 for engaging apertures 109 in a cartridge 108 to retain the cartridge 108 at one or more positions corresponding to alignment with the axial bore 106. The application or app may also display initial activation of the satellite launcher 100, position or movement of the satellite launcher 100 and elements thereof, and/or the cartridge 108 being deployed. A timer may be used to confirm time to travel for a satellite 116, for example measured in seconds. In other embodiments, the actuator 112 may be a chain and sprocket drive, a winch and cable drive, an air driven cylinder drive, spring driven/biased or a hydraulic cylinder drive, or a gear rack drive. In some embodiments, the gear rack drive comprise a gear drive and a gear pinion. The gear rack comprises same sized and shaped teeth at equal distances along a flat surface or a straight rod. The gear pinion may be cylindrical for converting rotational movement from an actuator into linear motion along or of the gear rack. The actuators 112 may be remotely controllable.

In some embodiments, the cartridges 108 comprise satellite tubes 120 for securely retaining satellites 116 such as darts, packer balls, and/or the like prior to injection into the wellbore. In some embodiments, the satellite tubes 120 are comprised of translucent plastic material, allowing an operator and/or sensor to readily detect the presence of a satellite 116, such as a dart. While a plastic material is described, a person of skill would appreciate that any translucent suitable material could be used. In some embodiments, the satellite tubes 120 may be comprised of a combination of translucent plastic and a more rigid material, such as stainless steel, carbon fibre, and/or the like to provide a more support structure or reinforcement or to provide a desired physical feature or profile. Further, a person of skill would appreciate that any material, including an opaque material could be used, but would affect the visibility of the dart. The satellite tubes 120 may be colour coded and/or numbered for identification.

The darts may be of any size and dimension but in some embodiments, the darts, including the dart body and sealing material, are 4" darts with an outside diameter of 3.6" or 5" darts with an outside diameter of 4.5" and having lengths about from 8" to 28. The darts may be many different types, including programmable darts, wherein a dart may be programmed along with packers set up downhole such that one or several packers may be activated as the programmable darts pass through to activate one or multiple stages of a wellbore. The dart may also be a mechanical dart, which activates one packer to activate one stage at a time.

The satellite tube 120 generally provides protection to the dart, ball, and or the like from external environments elements such as rain, snow, hail, ultraviolet waves, wind, and/or the like. In embodiments where the satellite tube 120 is comprised of a plastic material, the satellite tube 120 provide thermal insulation as plastics generally do not absorb heat and have a low rate of thermal conduction. This may be important under colder operating temperatures. The satellite tubes 120 may comprise a protective double-walled thermal capsule construction for insulating it from outside temperature and moisture.

Referring to FIG. 1A and FIG. 1B, in some embodiments, each cartridge 108X may comprises two or more satellite tubes 120 which are aligned relative the direction from distal the axial bore 106 and to the axial bore 106 such that the cartridge 108X may be moved from the distal position towards the axial bore 106 with two or more intermediate positions, wherein each intermediate position corresponds to a position where a satellite tube 120 of that cartridge 108X aligns with the axial bore 106 to deploy a satellite 116. The cartridge 108X may comprise one or more apertures 109 for engagement by a stop pin 118 in the actuator 112. The one or more apertures 109 for engaging with the stop pin 118 of the actuator 112 to retain the cartridge 108X at one or more positions corresponding to alignment with the axial bore 106.

In some embodiments, the satellite tubes 120 further comprise a closure 122 distal the wellbore, such as a cap, which may be permanently formed or removably attached to the satellite tube 120. In operation, the cap 122 may be removable for reloading satellites 116.

The satellite tubes 120 are wider than the axial bore 106 such that when one of the satellite tubes 120 is aligned with the axial bore 106, the satellite 116 contained therein is free to drop out of the satellite tube 120 and through the axial bore 106, while the satellite tube 120 is prevented from also going through the axial bore 106. The satellite tubes 120 do not need to be secured to the cartridges 108 but may be secured with a mechanism, such as with a ⅛ or ¼ turn, wherein the satellite tube 120 catches a small protruding pin in the cartridge 108, locking it into place within the cartridge 108, which may be used for transport.

Figure 3:
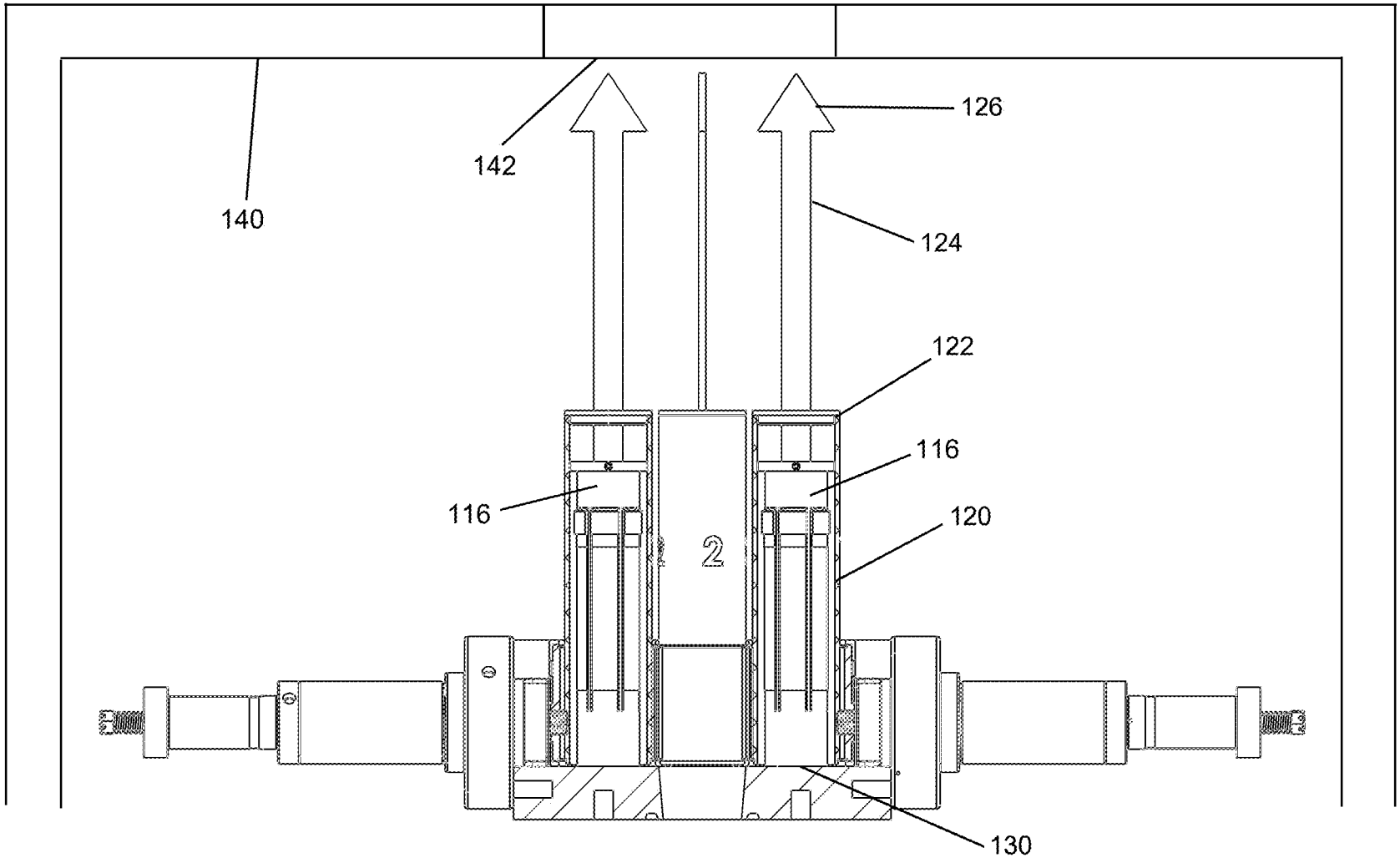
FIG. 3 is a cross-sectional view of the satellite injecting apparatus of FIG. 2 showing three loaded cartridges.
Figure 4:
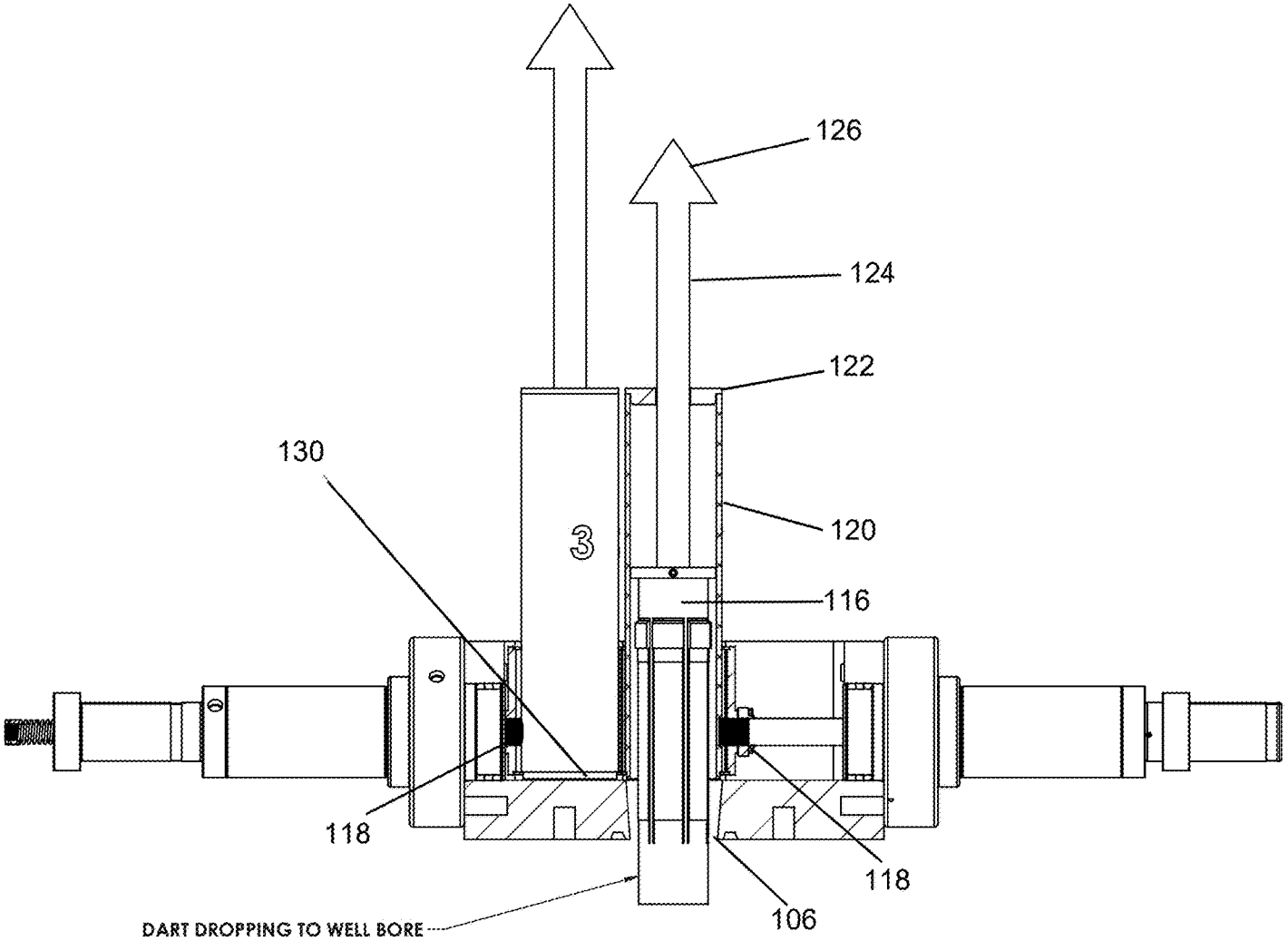
FIG. 4 is a cross-sectional view of the satellite injecting apparatus of FIG. 2 showing movement of a cartridge.
Figure 5:
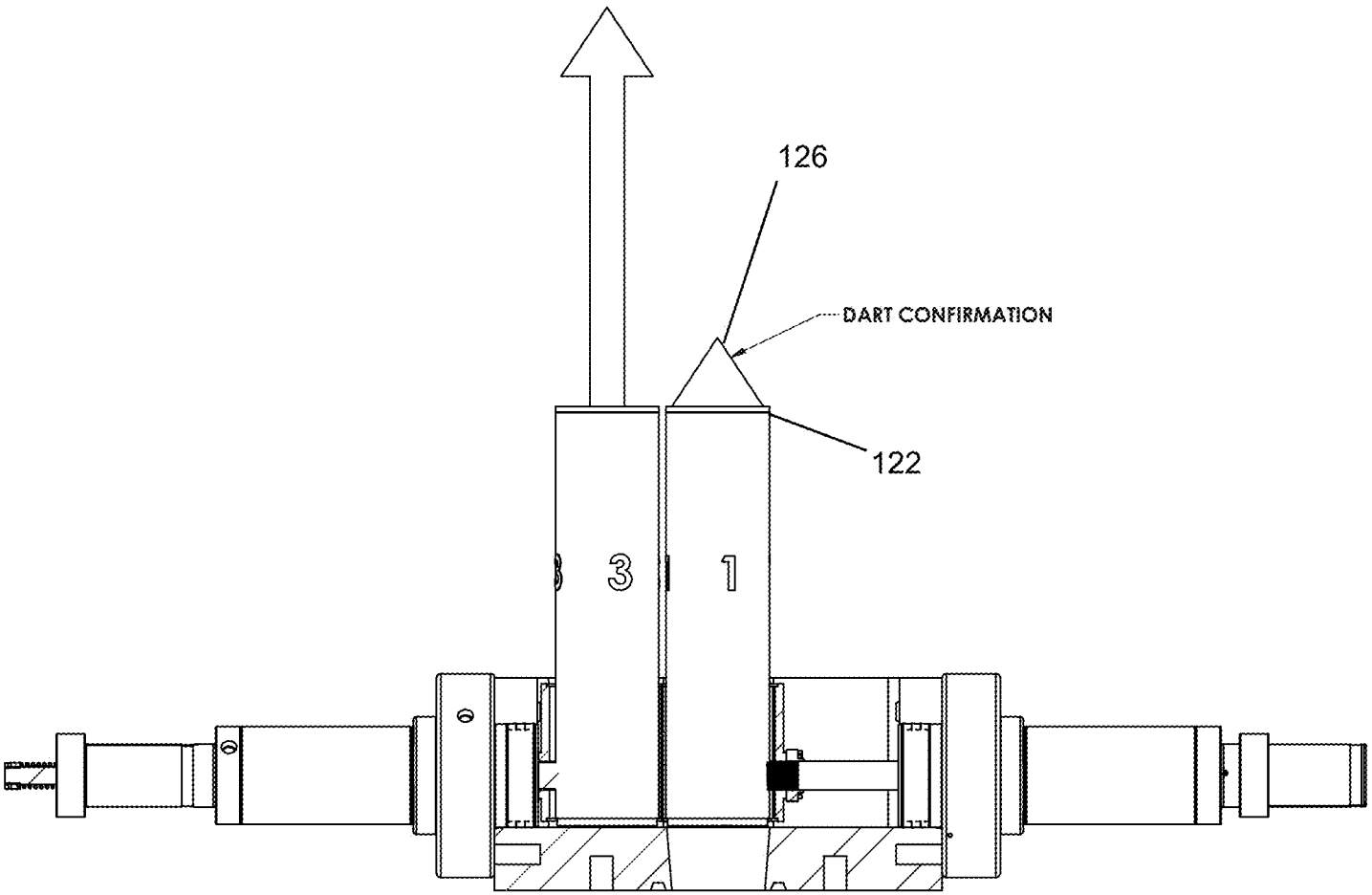
FIG. 5 is a cross-sectional view of the satellite injecting apparatus of FIG. 2 showing full depression of the indicator of a satellite tube after successful deployment of a satellite.

In some embodiments, the satellite tubes 120 may comprise an indicator 124 for visually confirming whether a satellite 116 has been deployed. In some embodiments, the indicator 124 comprises a rod axially movable through the cap. A portion of the rod may be inside the satellite tube 120 with a member to act against a satellite 116 such as a plate, acting like a piston, such that it stays up when a satellite 116 is present and down when the satellite 116 is not. Referring to FIG. 3, the rod may further comprise a confirmation arrow 126 at the end distal the housing 102 for further ease of confirmation. FIG. 3 illustrates the confirmation arrow 126 in a fully extended position as the rod rests against a satellite 116. FIG. 4 illustrates a satellite 116 in the satellite tube 120 being dropped into the wellbore and as a result the indicator 122 is lowered as visible by the lowering of the confirmation arrow 126. FIG. 5 illustrates an empty satellite tube 120, wherein the confirmation arrow 126 rests against the cap 122 indicating that the satellite tube 120 is empty. While an arrow is shown in the figures, a person of skill would appreciate that any design or shape could be used. Further, the rod and/or arrow may be colour-coded and/or numbered for ease of identification.

In some embodiments, the satellite tubes 120 may comprise one or more heating elements 130 for maintaining the satellite tubes 120 at a higher temperature than surrounding ambient temperature. The heating elements 130 may be electrical-based, fluid-based, oil-based, and/or the like. In some embodiments, the heating elements 130 may be heating coils that operate like radiator coils, wherein hydraulic lines are heated, circulated through the heating elements to maintain the higher temperature to keep the satellites 116 from freezing. The heating elements 130 maybe located around, within, or integrated with the satellite tubes 120. In some embodiments, the heating elements 130 are located at the bottom of the satellite tubes 120.

The actuators 112 may comprise a similar indicator, such as an arrow, ring, and/or any other shape working in conjunction with the actuator mechanism, for indicating the relative position of the corresponding cartridge to the axial bore 106. The indicator may also be colour-coded and/or numbered for ease of identification. This provides visual confirmation of the state of the actuator 122, and specifically when it is fully extended or full retracted position, as moving actuator 122 may pose safety issues or be using resources shared with other actuators.

In some embodiments, the satellite launcher 100 comprises a drop sensor to confirm that a satellite 116 has passed the axial bore 106. In embodiments where translucent components are used, this may operate through those translucent elements. In other embodiments, the drop sensor can be located within or proximate to the axial bore 106 to confirm the same.

Referring to FIG. 3, the housing 102 may also comprise a safety assembly 140 generally located above and in alignment with the axial bore 106. The safety assembly 140 may be a removable cap 142 comprising a robust material, such as metal, and/or a blank assembly. The safety assembly 140 may be removable to permit loading of a satellite tube 120 located thereunder, for example where satellite activation is not confirmed.

The axial bore 106 may be in direct communication with the wellbore. In some embodiments, the axial bore 106 may also be in connection with a deployment system. The satellite launcher 100 may comprise an adapter comprising an interchangeable sleeve to connect the axial bore 106 to the deployment system, such as a valve or remote valve. The adapter allows the system to be used in a variety of applications.

Figure 6:
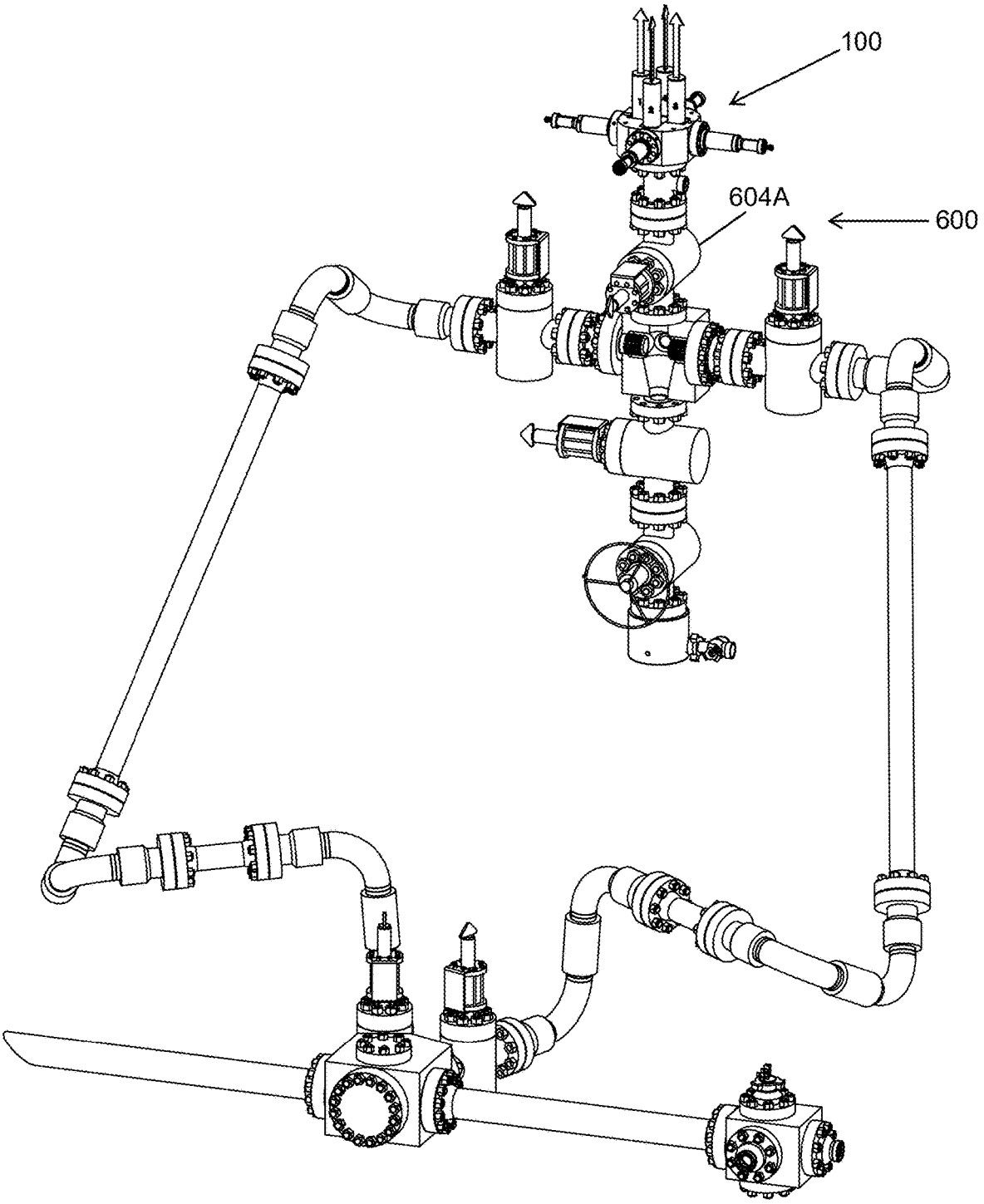
FIG. 6 is a perspective view of a satellite launcher system comprising the satellite injecting apparatus of FIG. 1 without a staging assembly.
Figure 7:
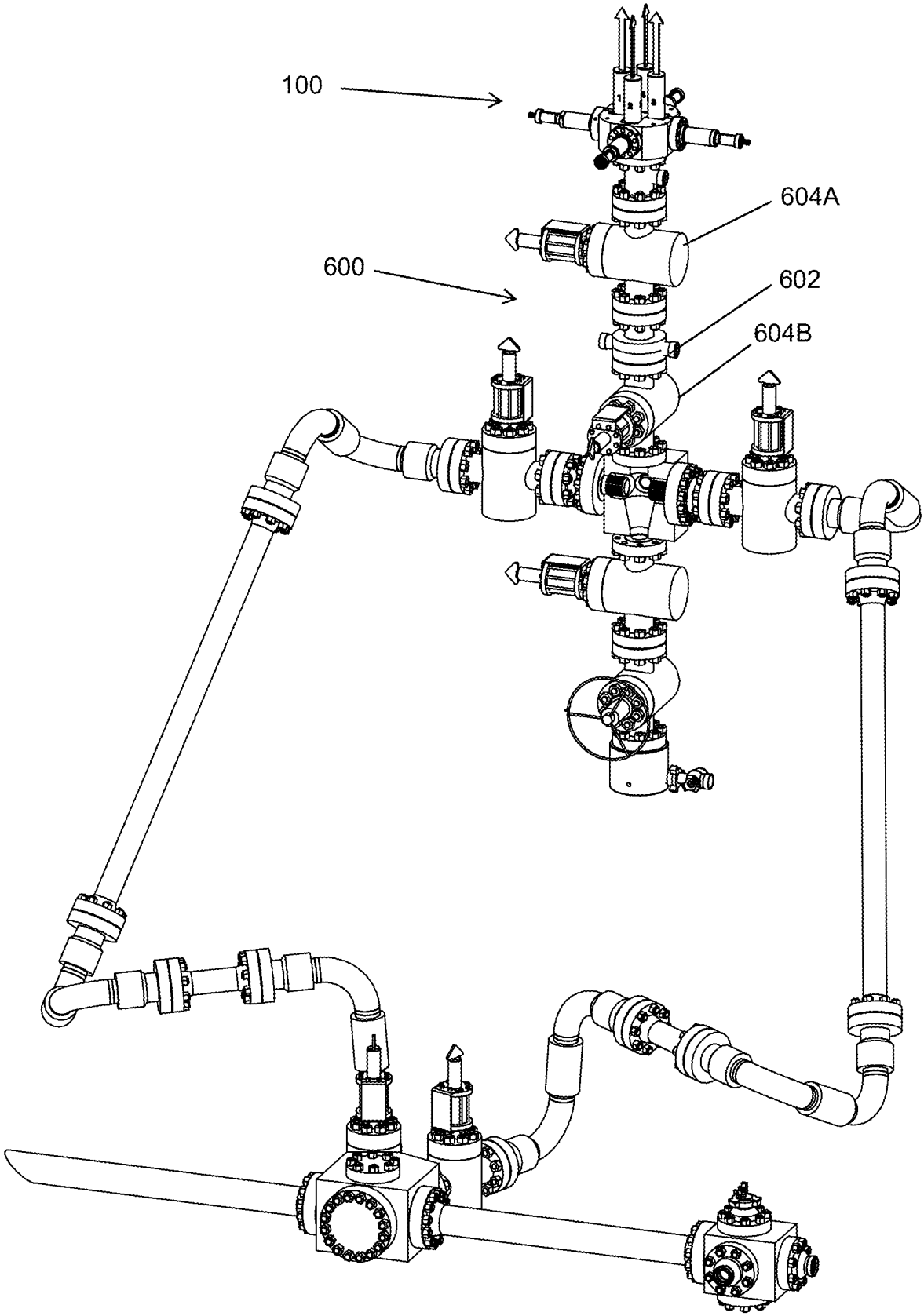
FIG. 7 is a perspective view of a satellite launcher system comprising the satellite injecting apparatus of FIG. 1 with a staging assembly.

The satellites 116 may be bled down or pressure launched. The satellites 116 may be direct dropped as illustrated in FIG. 6 or include a deployment system 600 as illustrated in FIG. 7. In an embodiment, a deployment system 600 as illustrated in FIG. 7, may comprise one or more actuators or gates 604A and 604B to selectively allow a satellite 116 from a satellite tube 120 to enter the wellbore. The actuators or gates 604A and 604B may be remotely operable. The deployment system 600 may comprise a first remotely operable upper gate 604A and a second remotely operable gate 604B with a staging or dry block 602 therebetween. The staging block 602 may comprise a pressure pump for equalizing pressure between the deployment system and the wellbore. The staging block 602 may also comprise a safety release if a valve vent of the deployment system unintentionally vents pressure. As a safety feature, the system 600 may comprise a sensor in the staging block 602 and may be configured such that the upper gate 604A is locked in a closed position when the second gate 604B is in an open position and/or if the staging block 602 is pressurized. This is to prevent a satellite 116 under pressure in the staging block 602 from being forced back towards the apparatus 100.

The apparatus provides a safe and economical means to complete pad wells and may be suitable for zipper fracs. Because of the quick loading and smaller capacity, the time that a dart potentially spends in extreme environments may be reduced. Smart darts may have batteries that benefit from less exposure to extreme weather and lessen the chance of a possible failure due to temperature or moisture. Further, as a result of the quick loading of cartridges, use of trays, and the like, the disclosed apparatus is suitable for use in applications, such as zipper fracs, where there are two or more wellbores using the apparatus that operate in an alternating manner such that while the apparatus on one wellbore is in operation, the apparatus on the other wellbores can be reloaded, providing further efficiencies.

Although a few embodiments have been shown and described with reference to the accompanying drawings, it will be appreciated by those skilled in the art that various changes and modifications can be made to those skilled in the art that various changes and modifications can be made to these embodiments without changing or departing from their scope, intent, or functionality as defined by the appended claims. The terms and expressions used in the preceding specification have been used herein as terms of description and not of limitation, and there is no intention in the use of such terms and expressions of excluding equivalents of the features shown and described or portions thereof.

What is claimed is:

1. A system comprising:

an apparatus for injecting a plurality of satellites into a wellhead, the wellhead having a wellbore, the apparatus comprising:

a housing adapted to be supported by the wellhead, the housing having an axial bore therethrough in communication with the wellbore;

one or more satellite cartridges arranged radially around the axial bore on a surface of the housing, each of the one or more satellite cartridges:

for releasably retaining at least one of the plurality of satellites, having an open end facing the surface, and moveable along the surface; and one or more actuators for moving the one or more satellite cartridges along the surface, each of the one or more actuators for moving the respective open end of one of the one or more satellite cartridges in alignment with the axial bore to inject one of the plurality of satellites into the axial bore;

a staging block in communication with the axial bore;

a first actuator to selectably obstruct fluid communication between the staging block and the axial bore, the first actuator for selectably releasing any one of the plurality of satellites into the staging block; and a second actuator to selectably obstruct fluid communication between the staging block and the wellbore, the second actuator for selectably deploying any one of the plurality of satellites into the wellbore.

2. The system of claim 1, wherein:

each of the one or more satellite cartridges comprises an aperture; and each of the one or more actuators comprise a stop pin, each stop pin of the one or more actuators for selectably engaging the respective aperture of one of the one or more satellite cartridges for selectably retaining one of the one or more cartridges in a fixed position on the surface in alignment with the axial bore.

3. The system of claim 1, wherein the apparatus further comprises one or more stackable trays for containing any of the one or more satellite cartridges, the stackable trays being stackable on the housing and other stackable trays.

4. The system of claim 1, wherein at least one of the one or more actuators is remotely controllable.

5. The system of claim 1, wherein at least one of the one or more actuators is one of a screw drive, a chain and sprocket drive, a winch and cable drive, an air driven cylinder drive, spring driven/biased, a hydraulic cylinder drive, and a gear rack drive.

6. The system of claim 5, wherein each of the one or more actuators comprise an indicator to visually indicate whether the respective actuator is proximate or distal the axial bore.

7. The system of claim 1, wherein each of the one or more of the satellite cartridges comprises at least one satellite tube for releasably retaining one of the plurality of satellites.

8. The system of claim 7, wherein each satellite tube comprise translucent plastic.

9. The system of claim 7, wherein each satellite tube further comprise metal.

10. The system of claim 7, wherein each satellite tube is at least one of colour coded and numbered.

11. The system of claim 7, wherein each satellite tube comprises a moveable rod axially extending from each respective satellite tube for indicating whether one of the plurality of satellites is in the respective satellite tube.

12. The system of claim 11, wherein the respective rod of each satellite tube comprises a distal end with an indicator thereon.

13. The system of claim 7, wherein each of the satellite tubes are thermally insulative.

14. The system of claim 7, wherein each of the satellite tubes comprise a heating coil.

15. The system of claim 7, wherein each of the satellite tubes comprise a cap on an end distal the wellbore.

16. The system of claim 1 further comprising a drop sensor to confirm that any one of the plurality of satellites has been injected to the wellbore.

17. The system of claim 1, wherein the plurality of satellites are at least one of darts and packer balls.

18. The system of claim 1, wherein the housing comprises a safety assembly.

19. The system of claim 1 further comprising a pressure sensor in the staging block, wherein, upon detection by the pressure sensor that the staging block is pressurized, the first actuator is configured to obstruct fluid communication between the staging block and the axial bore.

20. The system of claim 1, wherein the first actuator is configured to obstruct fluid communication between the staging block and the axial bore while the second actuator is open.

* * * * *